US006582123B1

(12) United States Patent
Tang

(10) Patent No.: US 6,582,123 B1
(45) Date of Patent: Jun. 24, 2003

(54) PACKAGE INCORPORATING A PRESSURE VENTING FEATURE

(75) Inventor: Luen Sing Tang, New Territories (HK)

(73) Assignee: Tecksom International Limited (BS)

( * ) Notice: Subject to any disclaimer, the term of this patent is extended or adjusted under 35 U.S.C. 154(b) by 0 days.

(21) Appl. No.: 09/544,841

(22) Filed: Apr. 6, 2000

(30) Foreign Application Priority Data

Jan. 14, 2000 (GB) ..... 0000930

(51) Int. Cl.[7] ..... B65D 81/34

(52) U.S. Cl. ..... 383/100; 426/118; 426/107; 426/113

(58) Field of Search ..... 426/118, 113, 426/107; 383/100, 101

(56) References Cited

U.S. PATENT DOCUMENTS

| | | | | | |
|---|---|---|---|---|---|
| 3,512,632 | A | * | 5/1970 | Wiggins | 426/118 |
| 3,672,915 | A | * | 6/1972 | Wiggins | 426/118 |
| 4,358,466 | A | * | 11/1982 | Stevenson | 426/118 |
| 4,810,844 | A | * | 3/1989 | Anderson | 426/118 |
| 4,874,620 | A | | 10/1989 | Mendenhall et al. | 426/113 |
| 5,061,500 | A | * | 10/1991 | Mendenhall | 426/118 |
| 5,655,842 | A | * | 8/1997 | Hagino | 426/118 |
| 5,928,553 | A | * | 7/1999 | Toshima et al. | 426/118 |
| 6,060,095 | A | * | 5/2000 | Scrimager | 426/118 |

FOREIGN PATENT DOCUMENTS

| | | | | |
|---|---|---|---|---|
| EP | 890521 | * | 1/1999 | 426/118 |
| JP | 3-234618 | * | 10/1991 | 426/118 |
| JP | 9-142540 | * | 6/1997 | 426/118 |
| JP | 9.216664 | * | 8/1997 | |
| JP | 10-17012 | * | 1/1998 | 426/118 |
| JP | 11-208682 | * | 8/1999 | 426/118 |
| JP | 11-208684 | * | 8/1999 | 426/118 |
| JP | 11-310278 | * | 11/1999 | 426/118 |

OTHER PUBLICATIONS

Snack Food 80(11), 30 "CPP Film Provides Top Seal Performance", Woody (Dialog Item 8, File 53), 1991.*

Japanese Packaging Report (34), p. 7 "Cereal Packaging" (Dialog Item 1, File 79), Apr. 1994.*

Thai Journal of Agricultural Science, 29(3) 357–372 Chinprahast et al (Dialog Item 1, File 51), 1996.*

* cited by examiner

*Primary Examiner*—Steve Weinstein

(74) *Attorney, Agent, or Firm*—Ostrolenk, Faber, Gerb & Soffen, LLP

(57) ABSTRACT

A bag(1) to define a containment region for food, said bag formed of a multiply plastics film to define a front panel and back panel and being square or rectangular in shape wherein said side edges(12) and bottom edges(6) of each panel are sealed to each other said bag further comprising at said sealed bottom, a vent passage(2) to allow the escape of some fluid from the containment region of said bag during heating, the vent passage provided between said front and back panels where a region(5) of the internal most ply(4) of said multiply plastic film of at least one of said front or back panels is of a less or non-heat sealable nature to the remainder the material of the internal most ply at the sealed bottom.

19 Claims, 3 Drawing Sheets

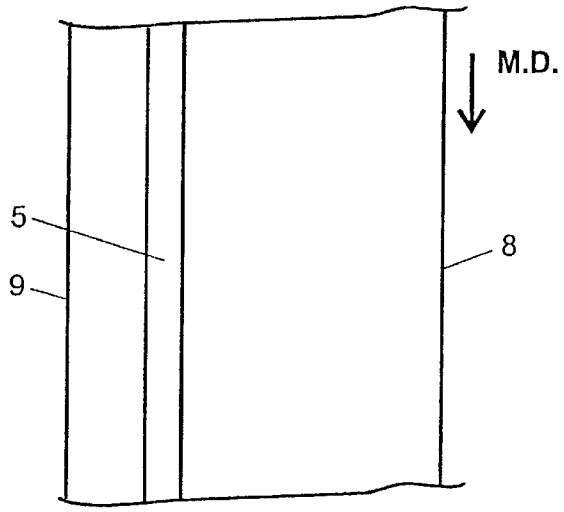
FIG. 6
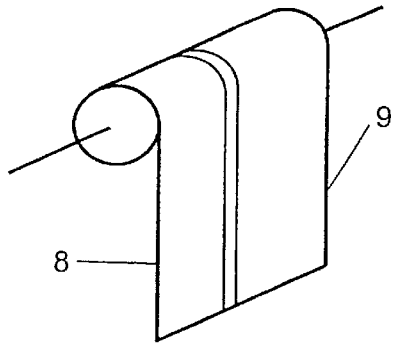
FIG. 7
FIG. 8
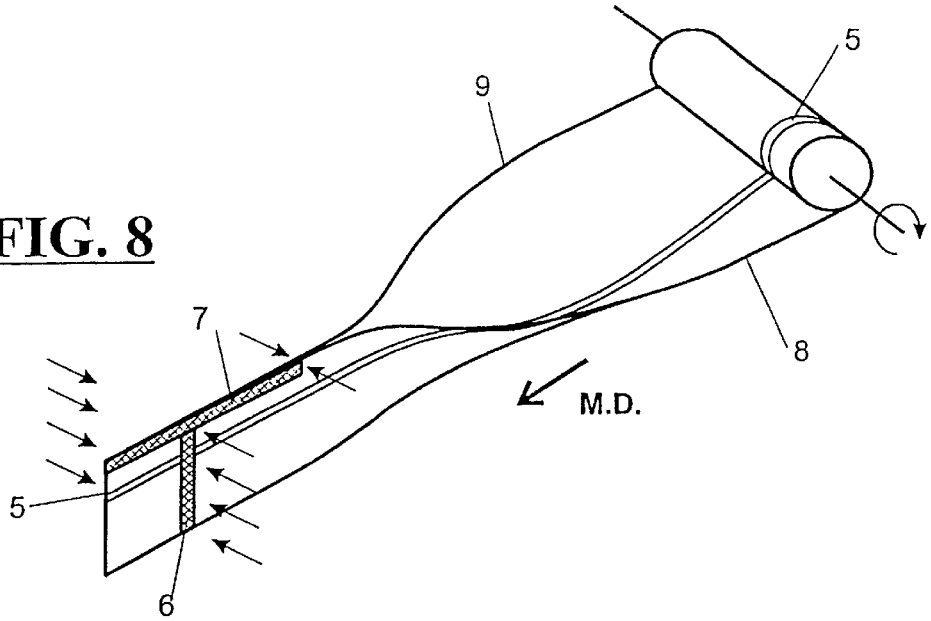
FIG. 9
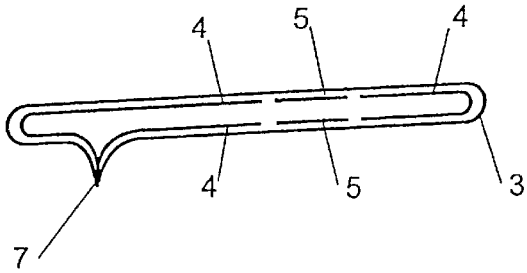

PACKAGE INCORPORATING A PRESSURE VENTING FEATURE

FIELD OF INVENTION

The present invention relates a package incorporating a pressure venting and related methods of manufacture. In particular although not solely the invention related to packages suitable for applications in microwave cooking.

BACKGROUND ART

Packages suitable for applications in cooking are known. Such include packages which are, adapted to allow the cooking of foods contained therein, in a microwave oven.

During the cooking of certain foods in such packages, it is desirable to maintain a level of moisture in order to prevent the foods from cooking dry. The presence of moisture within a package during the cooking of the foods will keep the food moist and more pleasant to the taste.

The common form of microwave package are made of plastic film material and can receive food through a mouth region. Water or other liquid may also be added to the contents whereafter the package is normally sealed to contain its contents and placed in the microwave. Upon the heating it will be appreciated that as a result of heating, the pressure inside of the package will increase. The increase in pressure may be such that the package may rupture and result in the spilling of the contents. Continued cooking after the rupturing may result in the food from cooking dry.

Bags with vent holes to deal with an over pressure whilst still allowing good containment of food also exist. As for example illustrated in U.S. Pat. No. 4,874,620, there is provided a package which allows for fluid to escape from the containment region during microwave cooking.

It is an object of the present invention to provide a package incorporating a pressure venting or to provide method of its manufacture to overcome the abovementioned disadvantages or to at least provide the public with a useful choice.

BRIEF DESCRIPTION

Accordingly in a first aspect the present invention consists in a bag to define a containment region for heating food contents said bag formed of a multiply plastics film to define a front panel and back panel each having side edges, a mouth edge and a bottom edge wherein said side edges of each panel are sealed and wherein the said bottom edges of each panel are substantially sealed to each other to define a sealed bottom of said bag substantially laterally to the longitudinal mouth to bottom edge direction said bag further comprising at said sealed bottom, a vent passage to allow the escape of fluid from the containment region of said bag during heating of its food contents, provided between said front or back panels where a region of the internal most ply of said multiply plastic film of at least one of said front or back panels is of a less or non-heat sealable nature to the remainder of the material of the internal most ply at the said scaled bottom.

Preferably said region of the internal most ply is of a different material to the remainder of said internal most ply.

Preferably said different material of said region extends from mouth to bottom edge of one of said front or back panels.

Preferably said inner most ply of one of said front of back panels comprises 3 longitudinally extending (mouth to bottom) strips wherein the intermediate of said 3 strips is of said different material.

Preferably said strips are in immediate juxtaposition one to the next.

Preferably, said intermediate strip is of smaller width (lateral to the longitudinal direction) than either of the other of said 3 strips.

Preferably said intermediate strip is of an oriented polypropylene.

Preferably said others of said 3 strips is of a cast polypropylene.

Preferably said bottom seal is generated by a heat sealing step to seal the front and back panels at said bottom together save for at said region defining the venting passage. Preferably said heat sealing is applied across the entire width of said bag at said bottom, and is at a temperature and/or dwell time sufficient to seal the overlapping layers of the inner most plies of the front and back panels together, save for where the region is defined by said oriented polypropylene.

Preferably said sealing temperature of said bottom is substantially 130 degrees Celsius.

Preferably said front and back panels are provided by a rectangular shaped sheet of said multiply film, folded longitudinally to define the said sides of said bag and wherein two opposite edges of said rectangular sheet have been heat scaled together.

Preferably at least one other ply of film material is provided external of said internal most ply.

Preferably at least one other ply is sealed to said internal most ply.

Preferably said at least one other ply laminated to said internal most ply.

Preferably said at least one other ply is co-extruded with said internal most ply.

Preferably said at least one other ply is of one rectangular shaped film.

Preferably said at least one other ply is of an oriented polypropylene.

Preferably said sealing temperature at which said bottom seal is generated is less than 180 degrees Celsius.

Preferably said bottom or mouth edge at one of the junctions of said intermediate strip with an other of said strips is provided with a notch.

Preferably said notch is of sufficient size to allow the initiation of a tearing of both panels substantially along the said junction.

Preferably said bag is provided with an unsealed mouth region.

Preferably said bag is provided with a sealable mouth region.

Preferably said sealable mouth region is provided by a reclosable profile strip.

Alternatively said bag is provided with a sealed mouth and food contents provided within the containment region thereof.

In a second aspect the present invention consists in a method of providing a vent passage through an edge seal of a bag defined by overlapping front and rear panels of a multiply film material, said method comprising:

heat sealing the entire of at least one overlapping edge of said front and rear panels where said edge seal is to be provided, at a temperature and dwell time which seals said front and back panels together save for a region to define said venting passage where one or both of the overlapping, surfaces of said front and back panel is provided with a material of a non or less heat sealable nature than the remainder of material of said overlapping surfaces.

Preferably said heat sealing of said at least one edge is achieved between heat sealing jaws of a bag forming apparatus, at a temperature of less than the heat sealing temperature of the said region.

Preferably said material of said region is an oriented polypropylene and the remainder of the material is of a cast polypropylene, and the heat sealing temperature is substantially 120 degrees Celsius.

In a further aspect the present invention consist is a sheet of film material for forming a front and back panel to define a bag having a sealed bottom, mouth and side edges, said film material being an assembly of at least two overlapping and integrally bonded plies of plastic wherein one of the outermost of said plies, to be at the inwardly facing surface of said front or back panels incorporates at least one panel of a dissimilar material to the remainder of said outermost ply, said dissimilar material being of a non or less heat sealable nature and positioned to be located at the bottom seal of the bag to be formed from the said sheet.

Preferably said sheet is a rectangular sheet of material.

Preferably said panel of dissimilar material is in juxtaposition with remainder of said outermost ply, and extends from one edge of said sheet to an opposite edge.

Preferably there is one of said panels of dissimilar material.

Preferably said dissimilar material is oriented polypropylene and the material of the remainder of said outermost ply is cast polypropylene.

Preferably there is one other ply to define said assembly, of the same size as the first mentioned said outermost ply.

Preferably said at least one panel is a longitudinal strip oriented in a direction of said panel parallel to the machine direction to be employed for the forming of said bags from said sheet of material.

In a further aspect the present invention consists in a method of producing a bag provided with a venting passage, said method comprising advancing in a longitudinal direction, a rectangular sheet of a multiply assembly, said assembly being of at least two overlapping plies wherein one ply is of at least 3 panels wherein said panels are in a side by side longitudinally extending relationship, at least one of the intermediate of said at least 3 panels being of a material of a less or non-heat sealable nature to the other of said at least 3 panels, forming said rectangular sheet into a tube by bringing together the longitudinal edges of said rectangular sheet such that said at least 3 panel side is internal sealing said longitudinal edges together, folding said tube into a lay-flat condition such as to proved a front and back panel heat sealing at a predetermined temperature and dwell time, the leading (substantially transverse to the longitudinal direction) edge of said tube said temperature and dwell time being such as to define, a bottom sealed substantially entirely across the lateral width of said tube at the leading edge save for at least one region to provide a venting passage for said bag defined between said two panels at the at least one intermediate ply separating a discrete bag from the tube, a bag length from said bottom seal.

Preferably said at least one intermediate panel is an oriented polypropylene and said other of said at least three panels are a cast poly propylene, wherein said heat sealing temperature is in the range of 130 to 180 degrees Celsius.

Preferably said heat sealing temperature is substantially at 130 degrees Celsius.

Preferably said separating of said discrete bag, simultaneously heat seals the leading edge of the tube.

Preferably prior to said separating of said discrete bag, said bag is filed with food contents, wherein the subsequent separating includes a heat sealing separation of the bag.

In a further aspect the present invention consists in a multiply sheet of plastic film material for the purposes of producing a bag according to the methods as hereinbefore described, or of a configuration of a bag as hereinbefore described.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

One preferred form of the present invention will now be described with reference to the accompanying drawings in which;

FIG. 6 is a plan view of part of a sheet material to form the tube and hence the bag of the present invention, FIG. 7 illustrates a perspective view of how the sheet material to form the bag of the present invention may be provided in a rolled form, FIG. 8 illustrates an example of a method of manufacturing the bag of the present invention from a sheet material as shown in FIGS. 6 and 7, FIG. 9 is a sectional view through a tube formed from one preferred form of the sheet material for the formation of the bag of the present invention.

DETAILED DESCRIPTION OF THE DRAWINGS

Figure 1:
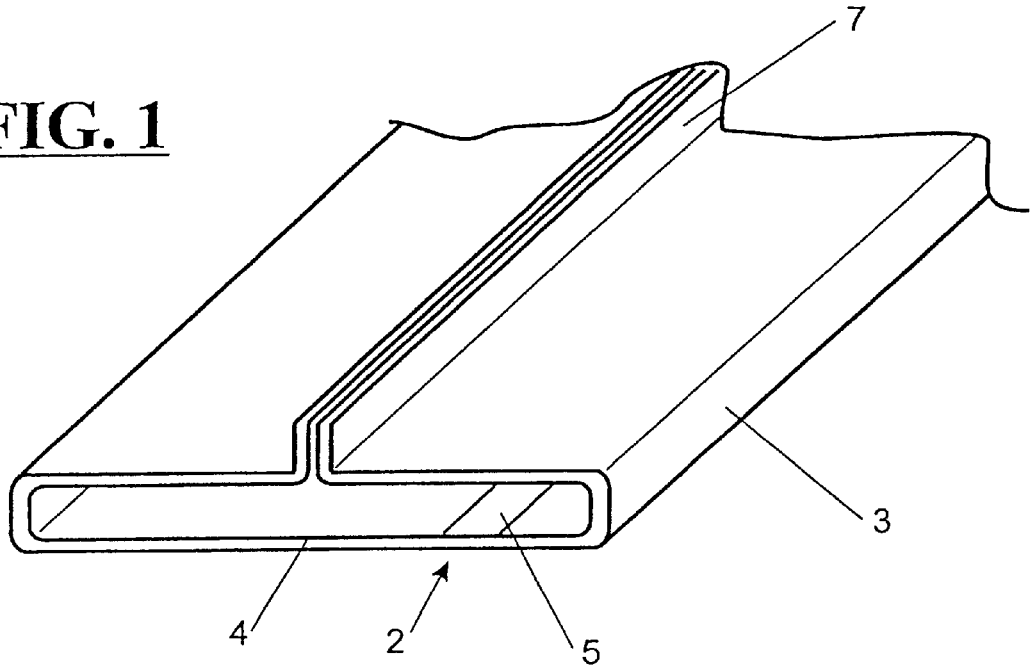
FIG. 1 is a perspective and exploded layer view of one example of a tube for forming the bag of the present invention illustrating an interior ply consisting of panels 4, 5 end one ply 3 external thereof.
Figure 2:
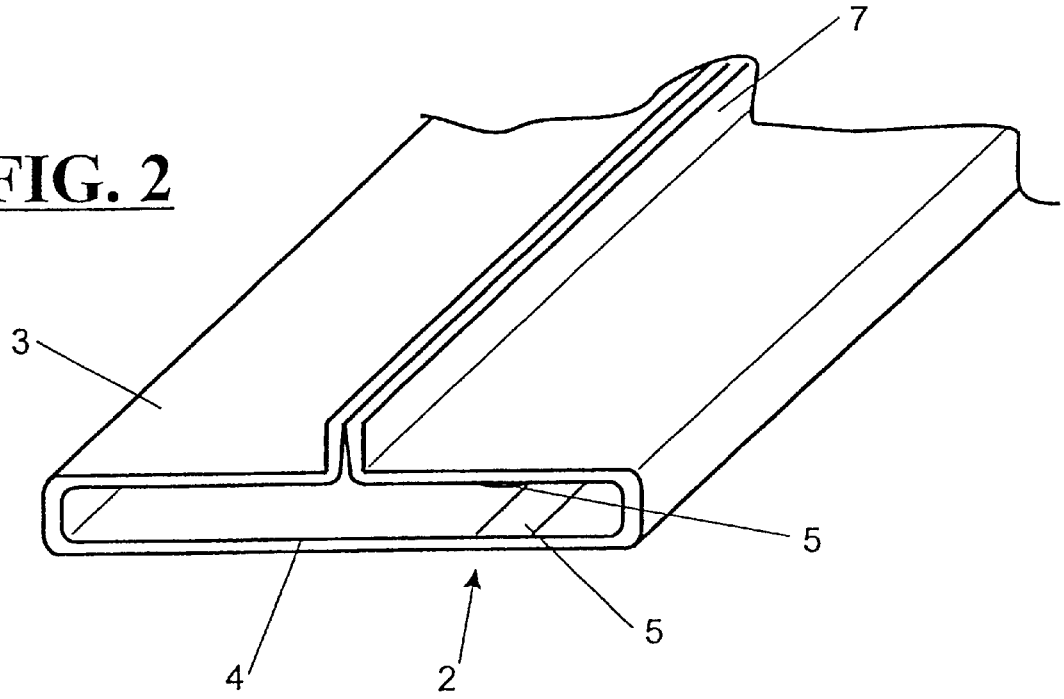
FIG. 2 is an alternative configuration of the arrangement as shown in FIG. 1 wherein there are two panels 5 of a different material to the panels 4 provided on the interior ply.
Figure 3:
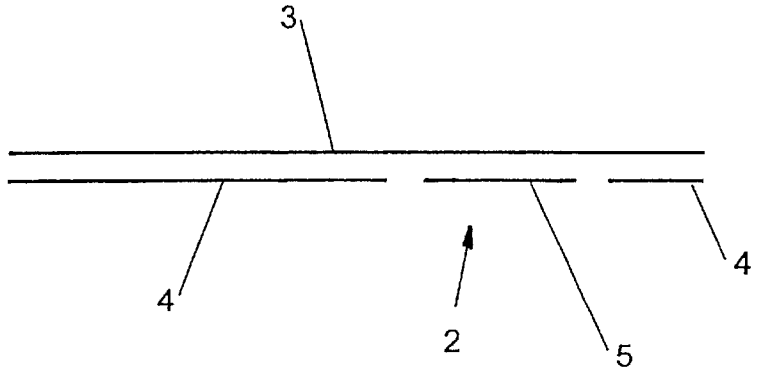
FIG. 3 is a sectional view through a sheet material to form the tube and hence the bags of the present invention shown as an exploded arrangement to illustrate the different materials provided.
Figure 4:
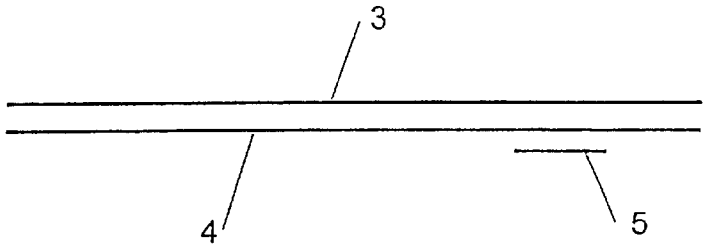
FIG. 4 is an alternative arrangement of the plies of the sheet material of the present invention.
Figure 5:
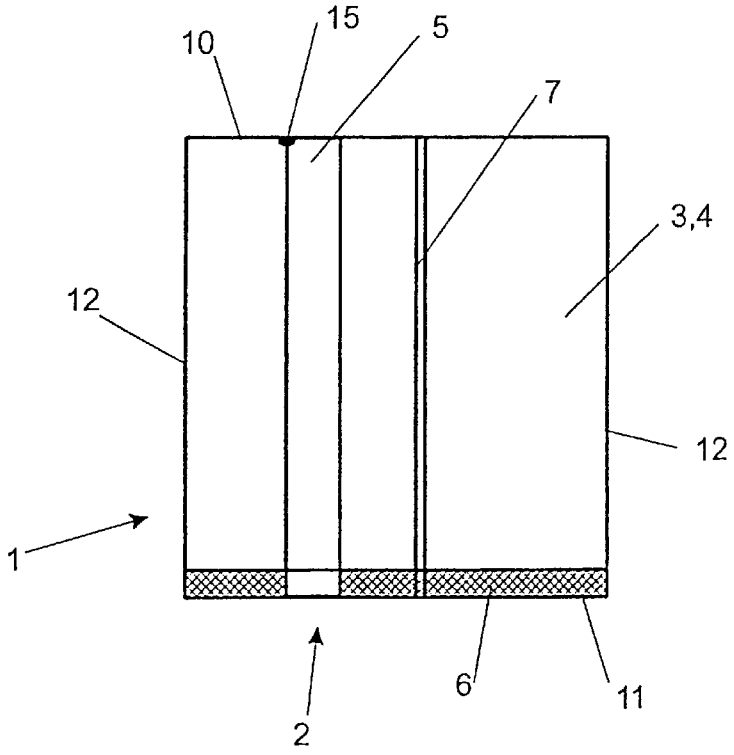
FIG. 5 is a plan view of a bag in a lay-flat condition of the present invention.

In a preferred form the present invention consists in a bag 1 which is most preferably formed from a tube of film material. The film material is preferably of a multiply assembly and with reference to FIGS. 1, 2, 3 and 4, some alternative configurations of this multiply assembly are shown. With reference to FIG. 5, the bag 1 has a mouth edge 10, a bottom edge 11 and side edges 12. In the preferred form where the bag is formed from a tube of material which may for example have been formed from a sheet of film material wherein the longitudinal edges have been brought together to define the tube, the bag consists of a front panel and a back panel. The front and back panels have sealed sides at the side edges 12 and these sealed sides may be formed as a result of the folding of the film material into the tube or may alternatively be formed by heat sealing separate sheets of materials at these side edges. In the most preferred form the bag of the present invention is formed from a tube defined by bringing together the longitudinal edges of a lay-flat sheet of film material. In this configuration, the tube is preferably formed as shown in FIG. 8 and is heat sealed along these longitudinal edges 8, 9 to define the seal 7 of the tube.

The bag of the present invention formed from the multiply assembly of sheet material, is designed to allow for the containment region between the two panels and defined between at least the bottom and side edges, and preferably also a sealed (or sealable) mouth edge, to contain food and be cooked in a microwave.

As such cooking, often involves heating to a significant degree, the air inside the containment region of the bag will expand, and when the pack is fully sealed either by having a heat sealed mouth edge or by for example a reclosable zipper element seal at the mouth edge, the bag is preferably provided with a region where such pressure can be vented.

The bag of the present invention is provided with such venting region 2 at at least the bottom heat seal (which may be considered a top seal if both ends are heat sealed and dependent on the bags orientation) of the front and back panels. This venting region 2 is a passage provided between the front and back panels through the bottom seal 6. In the preferred form, there is only one of such passages provided however the present invention may include one or more venting passage provided through the bottom seal.

As the bottom seal is a heat seal and is preferably provided as a one step heating process in the manufacture of the bag from the tube, it is the selection of materials at the venting region 2 which allows for the venting passage to be provided through the bottom heat seal.

As can be seen with reference to the figures, the multiply assembly of the bag of the present invention is of it least two plies. The inner most ply consists of at least three panels 4, 4, 5. The inner most ply is brought together in contact upon forming of the bag from the tube of material. Indeed in the most preferred form the tube of material has already had some of the portions of the inner ply, sealed at the longitudinal heat seal edge 7.

The at least three panels of the interior ply of the multiply assembly includes the venting passage 2 formed by an intermediate panel 5 between adjacent panels 4. As can be seen in the most preferred form the intermediate panel 5 is provided at the venting passage 2 and preferably extends substantially longitudinally (along the mouth-bottom direction) of the bag. The intermediate panel 5 is flanked on each side by the other panels 4 of the interior ply. The multiply assembly in its lay flat condition is such that at the edges 8, 9, the material of the panel 4 of the inner ply must be of a heat sealable nature to allow the heat seal strip 7 to be created. The intermediate panel 5 is of a material which is less or non heat sealable in the conditions at which the other panels 4 of the internal ply can be heat sealed.

Upon the application of the heat seal to define the bottom 6 of the bag, the overlapping portions of the panels 4 of the interior ply result in these panels from being heat sealed together to define a secure and unopenable bottom seal. The overlapping regions of the panel 4 with the panel 5, or the panel 5 with a like panel 5 between the front and back panels, does not seal under the heat sealing conditions of sealing the overlapping plies seal together and hence does not provide a heat seal (or at least provides a less strong heat seal compared to other regions of the bottom seal). The conditions of sealing of overlapping regions of panels 4 may be such that the temperature and/or dwell time of the application of heat to seal the overlapping portions of the panels 4 together is not sufficient to create an equally strong, or any heat seal of the bottom where the panel 5 is provided. The dwell time selection is usually a factor of the speed of the forming machine employed to form the bags of the present invention.

The CPP material can be heat sealed to each other at a temperature of substantially 130° Celsius or more. However at temperatures of less than 180° the CPP material will not seal to itself or to the CPP material.

Variations to such temperatures may apply where the materials used have different characteristics. The important aspect of the selection of materials and the selection of the heat sealing temperature is in relation to the differential in heat sealing characteristic of the two materials at the inward faces of the two panels at the bottom seal. The selected temperature of sealing must provide a seal to the majority of the bottom seal between the front and rear panels which would not rupture under normal pressures inside of the bag whilst the seal (if any) where the intermediate panel is provided at the bottom seal does rupture when the pressure inside of the bag increases to a level above the ambient pressure.

Therefore in the form of the invention as shown, the heat sealing of the bottom seal can occur at any temperature which is suitable to allow for the CPP materials of panels 4 to be sealed together. In an alternative configuration as shown in FIG. 9 where there is an overlap between two panels of material 5 (OPP) of the front and back panel, upon the generation of the bottom seal 6, the temperature of sealing must be less than the heat sealing temperature (preferably 180° Celsius to avoid the overlapping OPP material panels from being sealed together.

Whilst being of a less or non heat sealed nature, the front and back panels at the venting passage 2 of the bottom seal may still have some degree of adhesion to provide a limited seal of the venting passage whilst under no or little pressure. When the contents of the package is subjected to heating, the expansion of the air inside will increase to such a degree that before the package ruptures undesirably the venting passage 2 opens to allow for such expanded fluids to escape from the containment region of the pack.

The heat sealing may be achieved by known techniques of the provision of a heat sealing bar on both sides of the panels of the bag to thereby seal the panels together at the appropriate places.

The bag of the present invention can be provided in a form where the mouth region is unsealed to allow the user of the bag to place food and other contents into the containment region. The bag may thereafter be folded to provide a substantially sealed mouth region to allow for the containment region to be sealed. Alternatively the mouth region may be provided with openable closure means such as reclosable profile strip attachment provided on the front and back panel to thereby close the mouth region when desired.

In the form of the invention where the bag is provided with contents already included and where both the mouth and bottom edges are fully sealed, the bag may be conveniently opened by the tearing of the front and back panels along the line defined, where the intermediate panel 5 abuts the other panel 4. This line being a line of weakness in the form as shown in FIGS. 1, 2, 3 and 9, allows for a relatively straight line to be torn across (in a longitudinal direction) the bag to allow for access to the containment region of the bag to be achieved by the user of the bag. Preferably a notch 15 is provided at either the mouth or bottom edge of the bag to aid in the initiation of the tearing of the front and back panels along one of the lines of the junction of the panel 5 with the panel 4.

The multi layer assembly of the bag of the present invention is preferably provided by way of lamination. The at least one layer exterior to the internal layer of panels 4 and 5, is preferably of a plastics film material such as OPP.

The multi layer assembly may alternatively be provided by way of co-extrusion and the panel 5 may be provided to be incorporated as part of the interior layer by means other than providing a separate strip of material to define the panel 5. Treatment of the interior panel 4 to change the properties and characteristics of a region to define the panel 5 may be possible.

In the present invention, them may be more than one venting passage provided in the bottom seal, and furthermore a venting passage may be provided in one or both of the bottom or top seals of a pack of the present invention. Particularly where the present invention is sold where the containment region of the bag already contains food, such double ended venting provisions can easily be provided.

Unlike microwave cooking, in a conventional oven, heat penetrates into the food content through the bag surface. The materials used for the bag of the present invention where conventional oven cooking is to be employed, should be able to withstand higher temperature than that used in the case of microwave cooking. Examples of suitable materials for the intermediate panel of the inner layer are cellophane or PET (polyester). These materials are normally not heat sealable. The two outer panels of the inner layer become heat sealable by coating the cellophane or PET with a heat sealable material such as a polyethylene or polypropylene. Alternatives for the outer layer(s) may include aluminium foil, kraft paper or paper.

What is claimed is:

1. A bag defining a containment region for food, the bag comprising:

a front panel having opposite longitudinal side edges, a back panel opposing said front panel and joined to the front panel along the opposite longitudinal side edges; both of the front panel and the back panel are made of a multi-ply plastic film;

a mouth edge defined by the front panel and the back panel and between the longitudinal edges; a bottom edge defined by the front panel and the back panel and the bottom edge is opposite the mouth edge and between the longitudinal side edges;

the multi-ply plastics film comprising an internal ply, wherein the internal ply is on an internal surface of both of the front panel and the back panel, the internal ply further comprising at least one intermediate strip having two opposite edges, at least two other strips adjacent to respectively each of the opposite edges of the at least one intermediate strip, and the at least one intermediate strip and the at least two other strips are in immediate juxtaposed position forming the internal ply; the at least one intermediate strip is of a lesser heat sealable nature or a non-heat sealable nature as compared to the at least two other strips; the multi-ply plastics film further comprising at least one other ply sealed to the internal ply, wherein the bag is formable from a single roll of the multi-ply plastics film; and the bag being sealed by a heat seal of the front panel and the back panel along the bottom edge, and wherein the heat seal is weaker or non-existent at the intermediate strip as compared to the sealing between the at least two other strips, for allowing escape of some fluid from the containment region of the bag during heating.

2. A bag as claimed in claim 1 wherein the at least one intermediate strip is a different material than the at least two other strips.

3. A bag as claimed in claim 2 wherein the at least one intermediate strip is of smaller width transverse to the longitudinal direction than either of the at least two other strips.

4. A bag as claimed m claim 3 wherein the at least one intermediate strip is of an oriented polypropylene.

5. A bag as claimed in claim 2 wherein the at least one intermediate strip is of an oriented polypropylene.

6. A bag as claimed in claim 5 wherein the heat seal is applied across the entire width of the bottom edge.

7. A bag as claimed in claim 6 wherein the sealing temperature of the heat sealing is in a range from substantially 130 degrees Celsius to 180 degree Celsius.

8. A bag as claimed in claim 2 wherein the at least two other strips are of a cast polypropylene.

9. A bag as claimed in claim 1 wherein the multi-ply plastics film is an elongated sheet having two opposite edges and the multi-ply plastics film is folded longitudinally to define the front panel and the back panel such that the two opposite edges are opposed and the two opposite edges are sealed together by heat sealing.

10. A bag as claimed in claim 1 wherein the at least one other ply is laminated to the at least one internal ply.

11. A bag as claimed in claim 10, wherein the at least one other ply is of an oriented polypropylene.

12. A bag as claimed in claim 1 wherein the at least one other ply is co-extruded with the at least one internal ply.

13. A bag as claimed in claim 12 wherein the at least one other ply is of an oriented polypropylene.

14. A bag as claimed in claim 1 wherein either the bottom edge, or the mouth edge are provided with a notch between the at least one intermediate strip and the at least two other strips.

15. A bag as claimed in claim 14 wherein said notch is of sufficient size to allow the initiation of a tearing of both panels substantially along the said junction.

16. A bag as claimed in claim 1 wherein the mouth edge is not sealed.

17. A bag as claimed in claim 1 wherein the mouth edge is sealable.

18. A bag as claimed in claim 17 further comprising a reclosable profile strip along the mouth edge wherein the mouth edge is sealable using the reclosable profile strip.

19. A bag as claimed in claim 17 wherein the mouth edge is sealed after the food is inserted into the containment region.

* * * * *